US010781074B2

(12) United States Patent
Michel et al.

(10) Patent No.: US 10,781,074 B2
(45) Date of Patent: Sep. 22, 2020

(54) ELEVATOR CAR MOVEMENT MONITORING DEVICE, ASSEMBLY DEVICE AND ASSEMBLY METHOD FOR AN ELEVATOR SYSTEM

(71) Applicant: Inventio AG, Hergiswil (CH)

(72) Inventors: David Michel, Rotkreuz (CH); Simon Zingg, Langenthal (CH); Michael Geisshüsler, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 264 days.

(21) Appl. No.: 15/763,128

(22) PCT Filed: Sep. 22, 2016

(86) PCT No.: PCT/EP2016/072483

§ 371 (c)(1),
(2) Date: Mar. 26, 2018

(87) PCT Pub. No.: WO2017/050857

PCT Pub. Date: Mar. 30, 2017

(65) Prior Publication Data

US 2019/0055107 A1 Feb. 21, 2019

(30) Foreign Application Priority Data

Sep. 25, 2015 (EP) ..... 15186871

(51) Int. Cl.
*B66B 5/00* (2006.01)
*B66B 5/04* (2006.01)
(Continued)

(52) U.S. Cl.
CPC ..... *B66B 1/32* (2013.01); *B66B 5/0018* (2013.01); *B66B 5/04* (2013.01); *B66B 5/06* (2013.01); *B66B 19/00* (2013.01)

(58) Field of Classification Search
USPC ..... 187/247
See application file for complete search history.

(56) References Cited

U.S. PATENT DOCUMENTS 8,869,945 B2 * 10/2014 Harkonen ..... B66B 1/28 187/288
2011/0186385 A1 8/2011 Okada
2015/0014098 A1 1/2015 Stolzl et al.

FOREIGN PATENT DOCUMENTS

CN 6129311 B2 7/1986
CN 1558864 A 12/2004
(Continued)

*Primary Examiner* — Christopher Uhlir
(74) *Attorney, Agent, or Firm* — William J. Clemens; Shumaker, Loop & Kendrick, LLP

(57) ABSTRACT

A monitoring device for an elevator system is used with an assembly device for assembling a shaft retrofit and a method for monitoring an assembly platform. The monitoring device monitors movements of an elevator car and includes a sensor system for detecting a movement variable and at least one analysis device that evaluates the detected movement variable and compares it to a threshold. If the threshold is exceeded, a signal output is triggered to actuate a brake/catching device. The monitoring device selects the threshold from specified thresholds based on a state of the monitoring device. The specified thresholds include at least one normal operation threshold, and the monitoring device indicates a normal state as soon as specified connection elements are connected to it. The monitoring device further contains a checking routine for determining a state of the monitoring device, and selects the threshold from specified thresholds based on the state.

16 Claims, 3 Drawing Sheets

(51) Int. Cl.

| | |
|---|---|
| ***B66B 1/32*** | (2006.01) |
| ***B66B 19/00*** | (2006.01) |
| ***B66B 5/06*** | (2006.01) |

(56) References Cited

FOREIGN PATENT DOCUMENTS

| | | | |
|---|---|---|---|
| CN | 102123928 | A | 7/2011 |
| CN | 102333717 | A | 1/2012 |
| CN | 103159103 | A | 6/2013 |
| CN | 104718148 | A | 6/2015 |
| WO | 9840305 | A1 | 9/1998 |
| WO | 03055780 | A1 | 7/2003 |
| WO | 2014040861 | A1 | 3/2014 |

* cited by examiner

ELEVATOR CAR MOVEMENT MONITORING DEVICE, ASSEMBLY DEVICE AND ASSEMBLY METHOD FOR AN ELEVATOR SYSTEM

FIELD

The invention relates to a monitoring device for an elevator system, to an assembly device for assembling a shaft retrofit, and to a method for monitoring an assembly platform.

BACKGROUND

Elevator systems are installed in a building. The elevator system essentially comprises an elevator car that is connected via support means to a counterweight or to a second elevator car. The elevator car is caused to travel along essentially vertical guide rails, and the counterweight is caused to travel in the opposite direction, by means of a drive that may be selected to act on the support means or directly on the elevator car or counterweight. The elevator system is used to convey people and goods within the building to individual floors or a plurality of floors. The elevator system includes devices to secure the elevator car if the drive or support means fails. To this end, as a rule, brake devices or catching devices are used that can brake the elevator car on the guide rails, if needed. Such elevator systems are assembled in the building. This means that shaft material must be installed in a travel shaft. Assembly platforms are often used for this purpose. Such systems are known.

WO 98/40305 describes such an assembly process. In it, the pre-assembled elevator car or parts thereof are used as the assembly platform. A speed-limiting device is used for monitoring the assembly platform. The assembly platform includes catching devices that are actuated by the speed-limiting device when needed.

WO 2014/040861 shows a brake device for securing an elevator car during installation trips. A brake device of the assembly platform is selectively actuated or released.

In the aforesaid systems, an actuating element assembled in the shaft or a temporary speed-limiting device is required. This is expensive and sometimes difficult to install, since upper regions of the shaft must be accessible.

SUMMARY

The purpose of the invention is to provide a monitoring device that is simple to use, safe to employ, and that may possibly be reusable.

The solutions described in the following make it possible to satisfy these requirements in an optimal manner, at least individually.

An assembly platform that is used for assembling shaft material of an elevator system is provided with electromechanically actuatable catching devices. Furthermore provided on the assembly platform is a monitoring device. The monitoring device is provided for use in the future elevator system and is designed to monitor movements of an elevator car of the future elevator system. The assembly platform is thus used for creating the future elevator system. The monitoring device is designed for monitoring movements of the assembly platform during the assembly period and for monitoring the movements of the elevator car after said assembly has been completed. To this end, the monitoring device includes at least one sensor system for detecting a movement variable of the elevator car and an analysis device that is designed to evaluate the detected movement variable and compare it to a threshold or to a set of thresholds. If the threshold is exceeded, or if at least one of the thresholds is exceeded, a signal output is triggered and the catching device or a corresponding brake is actuated by means of this signal output. Thus the safety elements required for operating the elevator system may be used during installation of the elevator system. This is particularly advantageous when a car floor of the future elevator car, for instance, is used for the assembly platform.

In one solution variant, the monitoring device now comprises a checking routine for determining a state of the monitoring device and the monitoring device selects the threshold from specified thresholds as a function of this state. State of the monitoring device shall be construed to mean an overall state of the monitoring device in a system. This means, for example, that the monitoring device is not connected to necessary systems that are required for the final operation of the monitoring device in the elevator system. Thus allowance is made for the fact that not all elements of the elevator are present when it is assembled. For instance, elevator doors are missing, as are shaft information unit and control signals. Likewise, there is often no power connector, or only a temporary power connector. Since the monitoring device itself determines the status or state of the elevator system or monitoring device, it may place itself into a safe assembly operation mode or maintain such as long as necessary elements of the elevator are absent.

In one embodiment, the specified thresholds comprise at least one assembly threshold and one normal operation threshold. In addition, one state of the monitoring device is an assembly state. The checking routine indicates the assembly state as long as specified connection elements to the monitoring device are absent. The monitoring device selects the assembly threshold from the specified thresholds for as long as the checking routine indicates the assembly state. As long as the checking routine indicates the assembly state, the analysis device compares the evaluated movement variable to the assembly threshold in order to trigger the signal output and actuate the brake or catching device if the assembly threshold is exceeded. Thus there is a minimum safeguard for the assembly platform from the very beginning and an assembly team can operate the assembly platform safely. At least one assembly threshold and one normal operation threshold includes that one set of assembly thresholds or normal operation thresholds may be present. The values determined in the set may be adjusted to different assembly and normal operation phases or they may be adjusted to different movement behaviors such as a jolt, acceleration, travel segment, or even a travel time.

In one embodiment, in the assembly state the monitoring device further includes a reset function that resets the signal output and permits the actuated brake or catching device to be reset, wherein the reset function may be initiated manually, or may be initiated automatically if the analysis device determines an upward movement of the elevator car or if there is a drop below the assembly threshold during a specified period. Thus these may be reset in a simple manner after the assembly platform has been secured. Thus the monitoring device actuates the catching device after an unexpected downward jolt, for example. The catching device blocks further downward movement. The catching device is normally embodied self-locking. This means that the catching device must be unlocked, for instance using an upward movement, before it may be disengaged. Thus, the monitoring device may reset itself as soon as it determines that the assembly platform is at rest or that the catching devices were actuated. Thus the entire safety device may only be returned to the operation state by an upward movement.

In one embodiment, in the assembly state the monitoring device includes a dead man's switch so that if the dead man's switch is not actuated the signal output is triggered and the brake or catching device is actuated. Thus optimum assembly safety may be attained. A person skilled in the art of assembly may load material by means of the assembly platform and move said material to an assembly site. During the loading or even during the assembly of material, the dead man's control is deactuated. This means that the monitoring device initiates the brake or the catching device, that is, brings it to a braking state. The assembly platform is thus fixed to guide rails. This facilitates work from the assembly platform. A pedal or a switch must be actuated continuously in order to initiate the brake or catching device or to actuate the dead man's switch. The person skilled in the art of assembly carries this out actively as soon as he wants to deliberately cause the assembly platform to travel. As soon as he releases the pedal or switch, the dead man's switch is deactuated and the monitoring device initiates the brake or catching device. The pedal or the switch is preferably embodied such that the pedal or the switch is not actuated inadvertently.

A temporary connecting unit that supplies the monitoring device with electrical energy when it is in the assembly state is preferably provided. To this end, in one embodiment the connecting unit includes a power supply unit for connecting to a customary local electrical power network. Thus the customary local conditions for a construction or assembly site are met. The connecting unit includes, for example, a buffer that can bridge brief power outages.

Alternatively, the connecting unit includes an energy module having at least one electrical energy storage unit. The energy storage unit is designed to operate the monitoring device together with the associated brake or catching device. The energy storage unit is preferably exchangeable when needed. Thus the monitoring device may be operated essentially off-grid. In one variant, energy storage units are used as they are used for battery-operated tools, such as for instance a battery-operated screwdriver. These are easy to charge and can be exchanged rapidly.

The energy module or the electrical energy storage unit is preferably provided with a charging control element that indicates an insufficient charge reserve. When there has been a drop below a specified charge reserve, this monitoring device advantageously actuates the brake or catching device. Thus the assembly technician has a good over-view and can exchange or recharge the energy storage unit promptly.

In one embodiment, the connecting unit or the energy module has a buffer that maintains an energy supply for the monitoring device while the electrical energy storage unit is being exchanged. Thus periods of interruption may be kept brief.

In one embodiment, the connecting unit includes display elements for displaying an operation state of the monitoring device or even for displaying a travel velocity. However, this requires an additional connection to the monitoring device, which connection may be realized, for instance, via a communications connector.

In one embodiment, for detecting the movement variable, the sensor system includes at least two redundantly working accelerometers that detect an acceleration of the elevator car. The assembly threshold indicates a threshold acceleration and the signal output is triggered for actuating the brake or the catching device if the detected acceleration exceeds the indicated threshold acceleration during a specified period of time. Alternatively, the assembly threshold indicates a permissible assembly velocity and the signal output is triggered for actuating the brake or the catching device if a velocity determined from the detected accelerations exceeds the indicated permissible assembly velocity. Accelerometers are particularly well suited because they work independent of the environment. They do not need any external interface. They may be constructed as integral components of the monitoring device. The monitoring device may preferably be attached to the assembly platform in the manufacturing plant.

In one embodiment, the assembly threshold determines a travel velocity of preferably about 0.3 m/s (meters per second), but a maximum of 0.5 m/s. Alternatively or in addition, the assembly threshold determines, for instance as an additional assembly threshold, a limit acceleration of a maximum of gravitational acceleration, corresponding to 9.81 m/s2 (meters per second squared). The assembly threshold is preferably set as a maximum of 6.0 m/s2, however. In addition, the assembly threshold may also provide a temporally weighted trigger, for instance. If a specified acceleration of, for example, 6.0 m/s is exceeded only briefly, for instance during less than 50 ms, no triggering occurs. As soon as this acceleration is registered for longer than a specified period of, for example, 50 ms, the signal output is triggered to actuate the brake or catching device. The threshold is set such that it preferably takes into account a characteristic of means of movement that are used for moving the assembly platform. Typical means of movement are a cable device, a chain hoist, or other lifting means. According to safety regulations, the maximum velocity during assembly trips is 0.5 m/s, or the monitoring device must actuate the brake or catching device at a velocity of 0.5 m/s. At an assembly threshold of 0.3 m/s, there is enough of a safety interval to this velocity permitted by the safety regulations. The safety regulations may vary by country. Consequently the thresholds to be monitored may be defined differently.

Alternatively or in addition, the assembly threshold includes a temporally weighted travel velocity. This includes, for instance, that when a travel velocity of 0.2 m/s is exceeded over a prolonged period—which can mean, for instance, that the assembly platform is moving downward too rapidly due to overloading—the signal output for actuating the brake or catching device is triggered.

In one alternative embodiment, or preferably in an additional embodiment, another state of the monitoring device indicates a normal state and the checking routine indicates the normal state as soon as specified connection elements are attached to the monitoring device or are in stand-by mode. Consequently, the monitoring device selects the normal operating threshold from the specified thresholds as soon as the checking routine indicates the normal state, and the analysis device compares the evaluated movement variable to the normal operation threshold in order to trigger the signal output and actuate the brake or catching device if the normal operation threshold is exceeded. Thus the monitoring device may be seamlessly moved into a normal operation mode that permits normal operation of the monitoring device. Normally this step occurs if the assembly platform is constructed with car components, such as car body, walls, car doors, roof, and required control elements, and the elevator system is provided with drive means, support cables, and elevator control unit. Starting at the point in time of the normal state, the monitoring device does not release operation of the elevator system unless the attached elements indicate a state that is plausible to the sensor system of the monitoring device.

However, switching from the assembly state to normal state is linked to additional conditions. Thus, for instance, electronic confirmation of a decrease in quality of the car may be required.

In one embodiment, in the normal state the analysis device evaluates the detected movement variables, taking into account the specified connection elements. In one embodiment, the specified connection elements include at least one speed sensor, in particular a tachometer, for detecting a travel velocity, or a path sensor, for detecting traveled units of a path, or a position determination system. As a rule, in addition to accelerometers, at least one additional movement signal is used for reliably monitoring the elevator movements in normal operation. This additional movement signal is used for mutual plausibility control and for more precise evaluation of the movement process. Accelerometer and path sensor, in the form of an incremental coder, for instance, are driven by deflection rollers or guide rollers. Thus, in the normal state, the analysis device uses algorithms that calculate all detected movement variables together in order to reach a so-called verified or reliable movement variable. As a rule, these devices are not yet present in the assembly phase of the elevator system, and the corresponding locations in the monitoring device are not occupied. Therefore the absence of this device or these devices may be used as an indication that the elevator system has not yet been completely assembled and that it may therefore be operated only in the assembly mode. In the assembly state, therefore, the analysis device may in any case use other algorithms that are defined, taking into account the movement variables available in the assembly state. Thus specific assembly-related movement variables may be monitored. This results in a reliable solution, since in the assembly state operation is necessarily only possible at the slowest travel speeds, as long as the additional movement signal or other relevant connection element are lacking.

In an additional or alternative embodiment, the specified connection elements include a connector to an elevator control unit, safety circuit, or power supply. During normal operation, status information is frequently exchanged between elevator control unit and monitoring device. This may be maintenance information, operating information, etc. Such status information may be exchanged, for instance, via a bus connection such as a CAN bus. On the other hand, as a rule the monitoring device is incorporated into a safety circuit of the elevator system. The monitoring device opens this safety circuit, for instance, when the monitoring device determines that there is an uncontrolled travel movement of the elevator car or, naturally, if the catching device is actuated. An interruption in the safety circuit causes an elevator drive to shut down. In normal operation, as a rule power is supplied by a central power supply of the elevator system. The absence of one or more of these connection elements may be used as an indication that the elevator system has not yet been completely assembled and that it may therefore be operated only in the assembly mode.

For instance, the monitoring device may detect an absence of a connection element in that a detection signal of the connection element is absent, in that a reference resistance is absent, in that contacts are bridged by assembly plugs or a bridge head, in that, for instance, a mass signal is missing, in that a reflection signal of a code reader is absent, in that a query of the monitoring device via the bus connection is not answered or is incorrectly answered, in that a switch that is actuated by a connection element is not actuated, or in that other characteristic values of a connection element to be connected are absent.

In one embodiment, during manufacture plug-in positions may be provided with bridge heads that in the monitoring device a simple detection of the status of the monitoring device.

A method for assembling an elevator system preferably provides that a movable assembly platform is assembled in the elevator shaft for assembly purposes. This preferably occurs as soon as the lower-most guide rails are installed in the elevator shaft. The assembly platform may include parts of the future car floor, but it may also be a special work platform. A monitoring device and at least one brake or one catching device are attached to or on the assembly platform and electrically connected to one another. In any case, the monitoring device and the brake or catching device may be attached to the assembly platform even before the latter has been assembled. This especially makes sense when the future car floor is used as the assembly platform. The monitoring device is connected to an energy supply that, as a rule, is temporary. The monitoring device detects, essentially automatically, that important connection elements, such as an elevator control unit, a safety circuit, or in any case additional motion sensors, are absent or not connected. The monitoring device is in an assembly state and in this state permits only small or slow movements for as long as such connection elements are absent. Thus assembly tasks can be performed safely.

In an additional stage, a dead man's switch is also added on the assembly platform and connected to the monitoring device. Thus the assembly platform is always secured by means of the brake or catching device if there is no deliberate actuation of the dead man's switch.

Furthermore, the monitoring device automatically switches to a normal state as soon as essential connection elements, or connection elements deemed important, are connected. This permits a simple and safe transition to the normal operation phase. In particular, the same components that were already used for securing the assembly state are also used for operating the elevator system. This is particularly advantageous when, as stated in the foregoing, the car floor is equipped with the required components at the manufacturing site.

The invention shall be described using exemplary embodiments in conjunction with the schematic figures.

DESCRIPTION OF THE DRAWINGS

The following is shown.

In the figures, the same reference numbers are used for equivalent parts in all of the figures.

DETAILED DESCRIPTION

Figure 3:
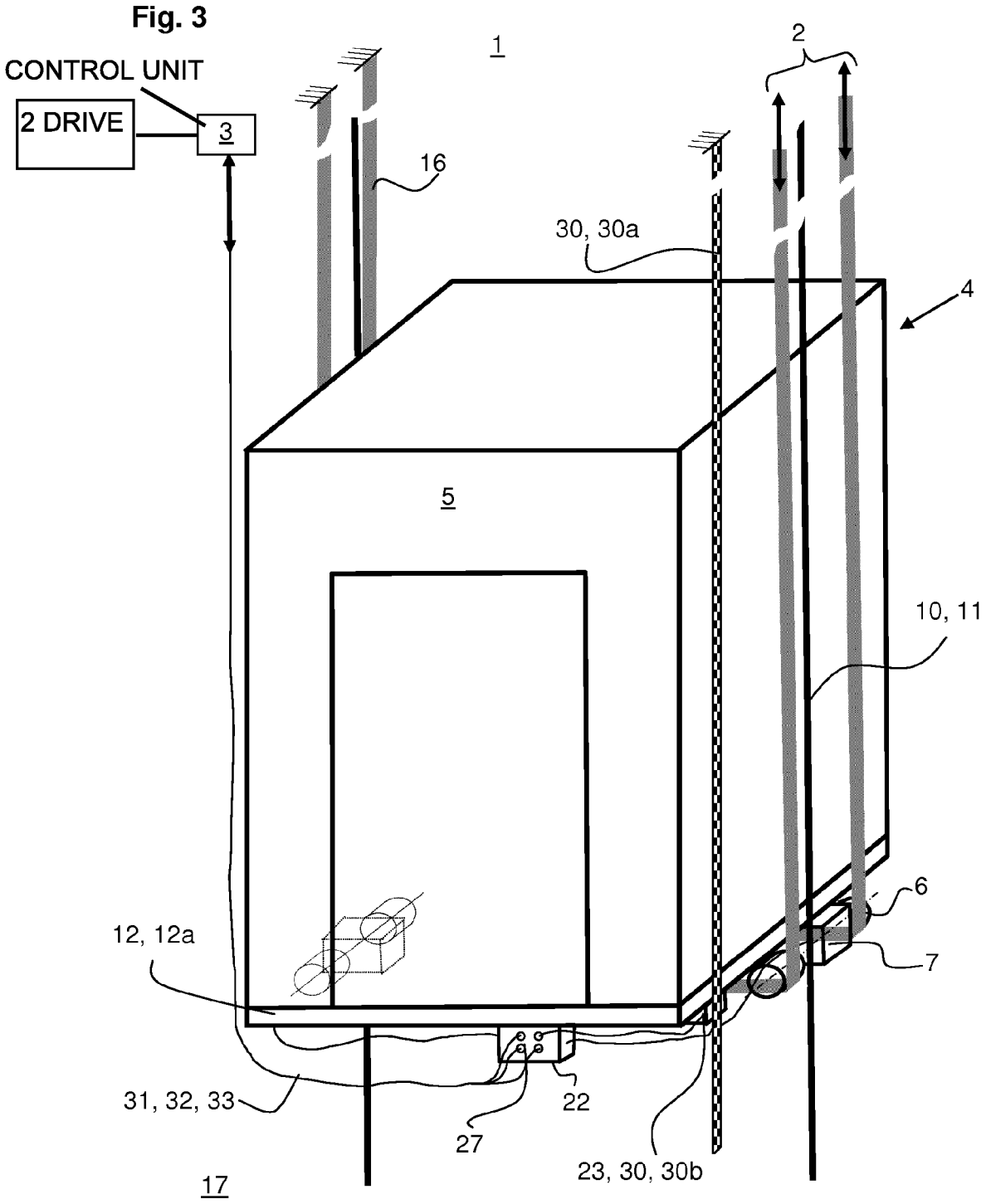
FIG. 3 illustrates an elevator system with built-on monitoring device.
Figure 4:
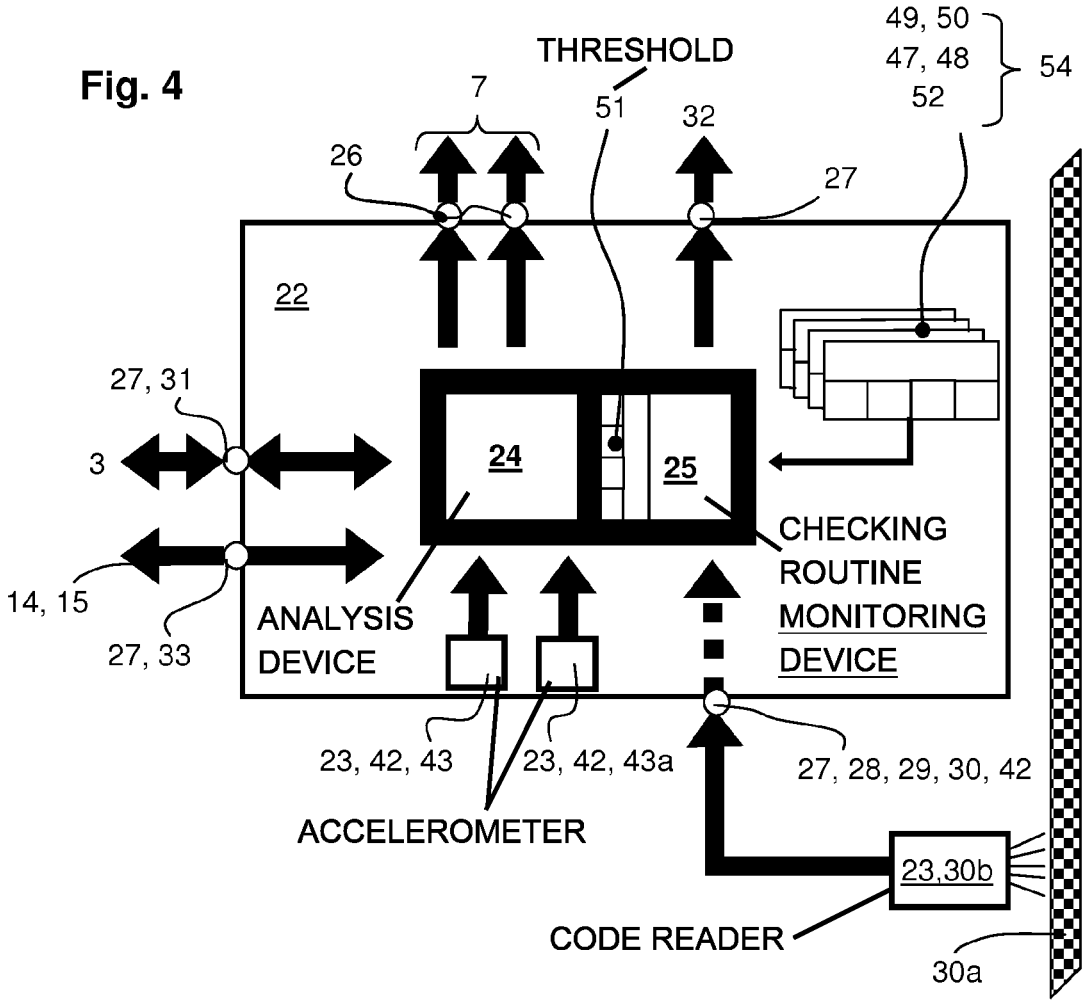
FIG. 4 illustrates the monitoring device in a normal state.

An elevator system 1, as illustrated schematically in FIG. 3 in the assembled state, includes an elevator car 4 that is embodied for transporting people or goods. The elevator car essentially comprises a car floor 12*a* and a car structure 5 having walls, doors, ceiling, and other devices required for operating the elevator car. The elevator car 4 is guided along guide rails 10, 11 and, in the exemplary embodiment, it is borne by a support means 16 via support rollers 6. The support means 16 are connected to a drive 2 that can move the elevator car accordingly. The drive 2 may be controlled or regulated by means of an elevator control unit 3. The elevator car 4 has a position determination system 30. The elevator control unit 3 uses the position and movement information from the position determination system 30 for controlling the drive. In the example in FIG. 3, the position determination system 30 comprises a coded belt 30*a* that is installed along a travel path of the elevator car 4 and a code reader 30*b*, arranged on the elevator car 4, that can read the code of the belt 30*a* and transform it into path units or position data.

Figure 2:
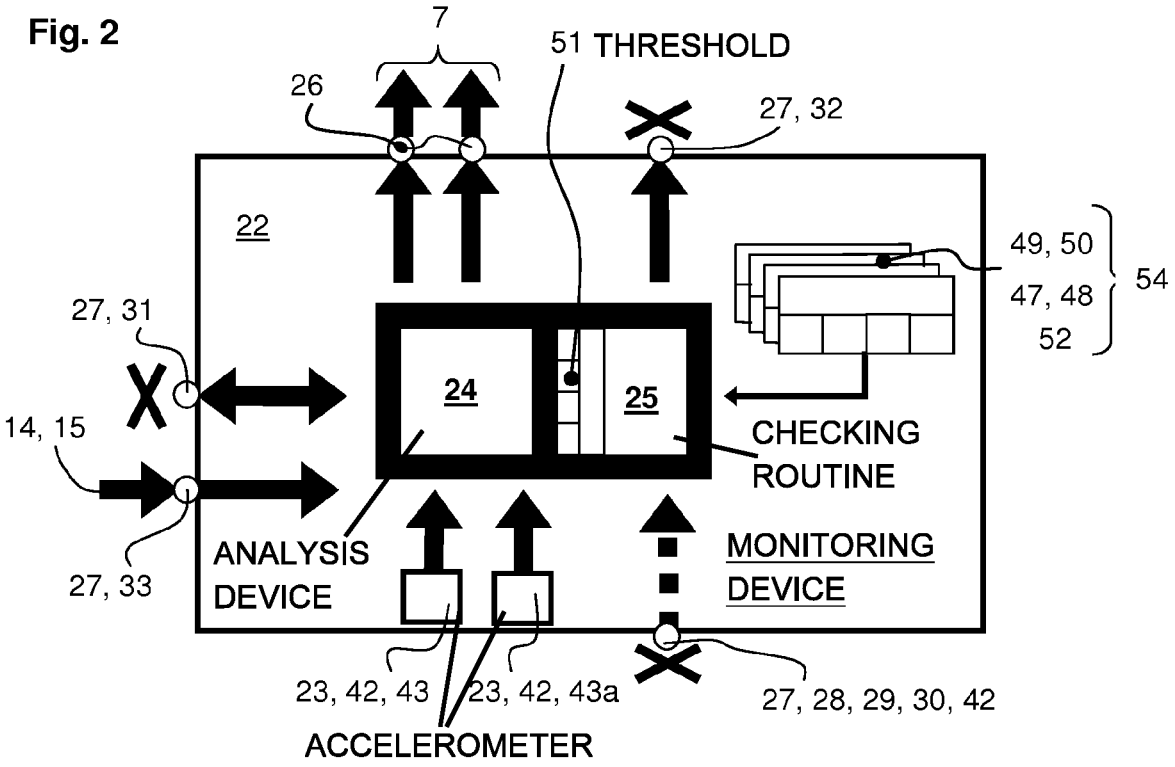
FIG. 2 illustrates a monitoring device in an assembly state.

The elevator car 4 furthermore comprises a brake or a catching device 7 that may, if needed, be caused to engage with the guide rails 10, 11 in order to brake and retain the elevator car. To this end, two brakes or catching devices 7 are used that can cooperate with the guide rails 10, 11 arranged on both sides of the elevator car 4. The brakes or catching devices 7 are controlled or regulated by a monitoring device 22. The monitoring device 22 has a sensor system 23 for determining movement variables 42 (see FIG. 2) of the elevator car 4. Data from the position determination system 30, but also internal sensors, may be used to this end. For safety reasons it is desired that different sensors acquire the movement data so that reliable data may be generated. The monitoring device 22 is naturally connected to the brakes or catching devices 7 in order to actuate them, that is, to brake the elevator car, or to release them. The monitoring device 22 is furthermore connected to a power source 33 and as a rule it is connected to the elevator control unit 3 by means of a communications interface 31, such as a CAN bus. In addition, as a rule the monitoring device is incorporated into a safety circuit 32. As a rule, when the brakes or catching devices 7 are actuated, the safety circuit of the elevator system is controlled such that the drive of the elevator system is stopped.

Figure 1:
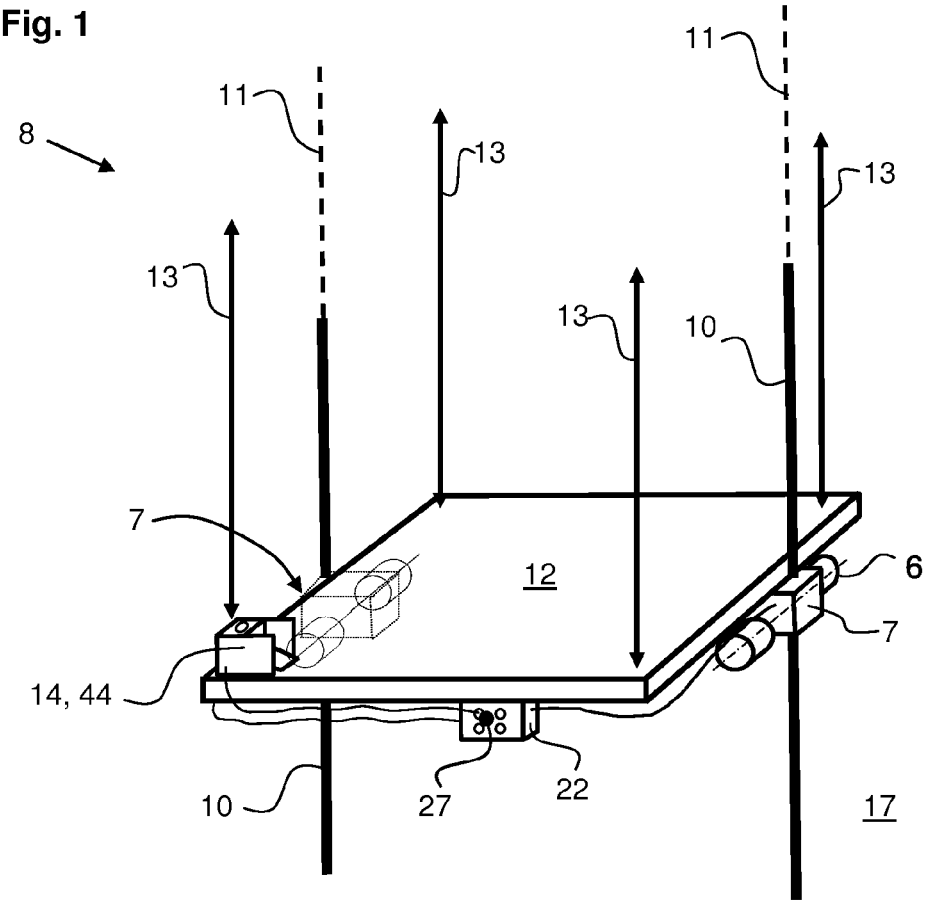
FIG. 1 illustrates an assembly device with built-on monitoring device.

During the construction of the elevator system, during an assembly process many sub-groups of the elevator system 1 are constructed and installed in an elevator shaft 17 in a specified sequence. An assembly device 8 including an assembly platform 12, as illustrated in FIG. 1, is often used for this purpose. First guide rails 10 are installed in the region of the lower end of the elevator shaft for this purpose. The assembly platform 12 is installed in these first guide rails 10. The assembly platform 12 may be raised or lowered by a traction means 13 that is installed or attached in an upper region of the elevator shaft 17. The assembly platform 12 is guided by means of the first guide rails 10. Now additional guide rails 11 may be raised by means of the assembly platform 12 and may be installed in a working manner from the assembly platform 12 so that the travel shaft 17 may be equipped starting from the bottom and working upward. As may be seen from FIG. 1, the future car floor 12*a* or parts of the elevator car 4 are frequently used as the assembly platform 12. In any case, components, such as the future support rollers 6, may be preassembled on the assembly platform 12. Likewise, the brakes or catching devices 7 are built onto the assembly platform 12 and, in cooperation with the guide rails 10, 11, they act as locking brakes for securing the assembly platform.

The monitoring device 22 is also built onto the assembly platform 12. The monitoring device 22 is provided for use in the future elevator system 1 and is consequently designed to monitor movements of an elevator car 4 of the future elevator system 1. The monitoring device 22 is designed such that it can monitor the movements of the assembly platform 12 during the assembly period and can also monitor the movements of the elevator car 4 after said assembly has been completed. As may be seen in FIG. 1, during the assembly, the elevator control unit 3 is naturally absent or there is no proper power supply. As a rule, there is also no safety circuit and the coded belt for the position determination system 30 is also absent. Corresponding connection sites 27 on the monitoring device 22 are thus not occupied and, instead of a proper power supply, according to the exemplary embodiment in FIG. 1, a connecting unit 14 is provided that supplies the monitoring device 22 and the associated brakes or catching devices 7 with required energy, preferably electrical energy.

The monitoring device 22 now detects that relevant connection elements 27 are absent. For instance, the monitoring device detects this in that a detection signal of the connection element is absent, in that a reference resistance is absent, in that contacts are bridged by assembly plugs, in that, for instance, a mass signal is missing, in that a reflection signal of a code reader is absent, in that a switch that is actuated by a connection element is not actuated, or in that other characteristic values of a connection element to be connected are absent. These are examples that may be set up or even added by the person skilled in the art. In another example, the absence of the connection to the elevator control unit 3 may be detected in that a query of the monitoring device 22 via the bus connection or the corresponding communications interface 31 does not receive a reply or receives an incorrect reply. As long as these connection elements, or at least a selection of specified connection elements, are absent, the monitoring device 22 remains in an assembly state 49, which shall now be explained in connection with FIG. 2.

The monitoring device 22 includes the sensor system 23 for detecting a movement variable of the elevator car. In the embodiment according to FIG. 2, this comprises two redundantly working accelerometers 43, 43*a*. The two accelerometers 43, 43*a* determine movement variables 42, in the form of accelerations, of the assembly platform 12. The two accelerometers 43, 43*a* are components of the monitoring device 22. The monitoring device 22 is connected via signal outputs 26 to the brakes or catching devices 7. Furthermore, there is an at least temporary energy supply 15 by means of the connecting unit 14. The other connection elements 27 are absent, in particular the connection to the elevator control unit 3, the connection of the safety circuit 32, and, in the present case, also the connection of an external sensor for detecting the movement of the elevator car, such as for instance a velocity sensor 28, a path sensor 29, or the coded belt 30*a* of the position determination system 30. A checking routine 25 arranged in the monitoring device 22 detects the absence of individual or of all of these connection elements 27 and puts the monitoring device 22, or an analysis device 24 of the monitoring device 22, in the assembly state 49 or leaves the monitoring device 22 in the assembly state. This means that an evaluation algorithm that relates to the evaluation of the two accelerometers 43, 43*a* is specified to the analysis device 24. At least one threshold 51 that limits the movement parameters of the assembly platform 12 is established for an assembly threshold 50. Often a set of thresholds is used instead of an individual threshold 51, as is explained in the general section. Thus when a threshold 51 is discussed in the following, this shall be construed to include a set of thresholds. The corresponding evaluation algorithm, as well as the corresponding assembly threshold 50, is stored in a parameter set 54 that is associated with the assembly status 49. The parameter set 54 thus comprises specified thresholds 52 that are associated with the corresponding state. The assembly threshold(s) 50 comprise permissible travel velocities and they comprise permissible accelerations, as well as possible time ranges during which specific acceleration values or travel velocities must not be exceeded. The assembly thresholds 50 are tailored to the assembly requirements, as was also explained in the general section of the description. In the assembly state 49, therefore, the monitoring device 22 takes on the threshold(s) 51 from the specified thresholds 52 of the corresponding parameter set 54.

The analysis device 24 compares the movement variables 42 determined from the signals of the two accelerometers 43, 43*a*, in particular a movement velocity and a current acceleration state, to the assembly thresholds 50. As soon as the corresponding assembly thresholds have been exceeded, the signal output 26 or signal outputs 26 are triggered and the brakes or catching devices 7 are actuated. It should be noted that the brakes or catching devices 7 as a rule are designed such that they are kept open when supplied with current and that they are actuated, that is, they close, if no current is being fed. Triggering the signal output 26 thus means that the signal output is switched without power.

In addition, provided on the assembly platform 12 is the connecting unit 14 that supplies the monitoring device 22 and the associated brakes or catching devices 7 with required energy. Such a connecting unit 14 is explained in greater detail in FIG. 5.

The connecting unit 14 includes an energy module 14*a* in the form of a rechargeable electrical energy storage unit 14*b*. The energy storage unit 14*b* is designed to operate the monitoring device 22 together with the associated brake or catching device 7. The energy storage unit 14*b* is exchangeable when needed. The energy storage unit 14*b* may be a battery. The battery may be charged in an appropriate charging device. Naturally a connection to an on-site power supply is also possible.

Figure 5:
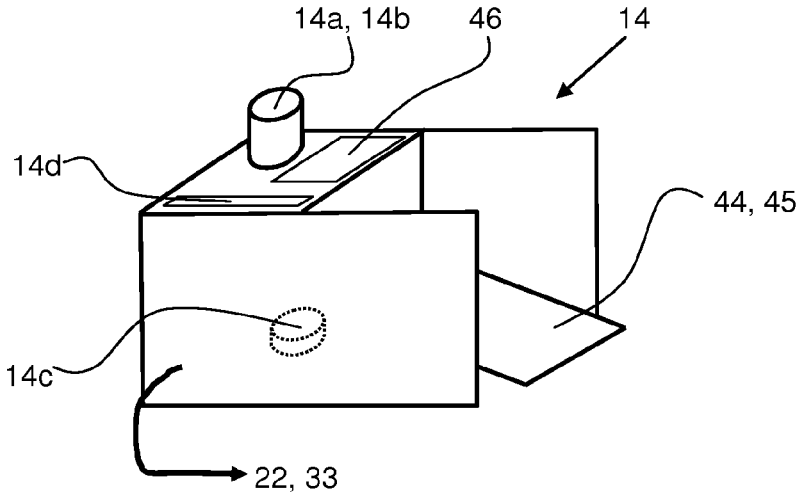
FIG. 5 illustrates a connecting unit with integrated dead man's switch.

The connecting unit 14 is provided with a charging control element 14*d* in the embodiment in FIG. 5. Thus a charge reserve may be evaluated. At the same time, the brake or catching device may be actuated when there has been a drop below a specified charge reserve. Moreover, the connecting unit 14 has an optional buffer 14*c* that maintains an energy supply for the monitoring device while the electrical energy storage unit is being exchanged. The connecting unit 14 illustrated in FIG. 5 furthermore includes optional display element 46 for displaying an operation state of the monitoring device. A display of an instantaneous travel velocity may also be displayed at times. In any case, a connector of the communications connector 31 of the monitoring device 22 is used for this.

As a special feature, according to FIG. 5 the connecting unit 14 comprises a so-called dead man's switch 44. This dead man's switch 44 causes the brake or catching device 7 to be actuated if the dead man's switch is not actuated. To this end, a pedal 45 is arranged on the connecting device 14. A person involved in the assembly operates the pedal 45 with his foot. If the pedal 45 is not being depressed, the monitoring device 22 actuates the brake or catching device 7. Thus the assembly platform 12 is normally held by the brake or catching device 7 if it is not deliberately in the travel mode. This means that it is still for assembly tasks and does not move. If the assembly platform 12 is moved, the person performing the assembly is deliberately depressing the pedal, so that the monitoring device 22 opens the brake or catching device 7. The assembly platform may then be moved by operating the traction means 13 or an associated lift device.

If the travel shaft 17 is now assembled in the manner illustrated, the elevator car is also complete as illustrated in FIG. 3. This means that the car structure 5 is built onto the assembly platform 12, which consequently becomes the car floor 12*a*. With this completion, the missing connection elements 27, in particular the connector to the elevator control unit 3, the connector for the safety circuit 32, and, in the present case, the position determination system 30, as well, are connected to the monitoring device 22. Likewise, the temporary connecting unit 14 is removed and the monitoring device 22 is connected via the connector 33 to the proper power supply for the elevator system.

The checking routine 25 arranged in the monitoring device 22 now detects that the required connection elements 27 are connected and puts the monitoring device 22, or the analysis device 24 of the monitoring device 22, in a normal state 47. This means that an evaluation algorithm or computer algorithm that relates to the evaluation of the two accelerometers 43, 43*a* and the attached position determination system 30 is specified to the analysis device 24 and that the threshold 51 or the set of thresholds that limit the movement parameters of the elevator car 4 are established corresponding to normal operation thresholds 48. The corresponding evaluation algorithm, as well as the corresponding specified thresholds 52 or the corresponding normal operation thresholds 48 are stored in the parameter set 54 that is associated with the normal state 47. The normal operation thresholds 48 comprise maximum permissible travel velocities, always taking into account a position of the elevator car 4 in the travel shaft 17, and they comprise permissible accelerations, as well as possible time ranges during which specific acceleration values or movement variables must not be exceeded. A plurality of normal states 47 may be stored in the parameter set 54 and may then be selected, for instance, for a service or maintenance trip or even for trips in the event of fire or the like.

The embodiment illustrated may be modified. For instance, instead of the illustrated position determination system 30, other sensors may be used for detecting movement variables. Thus, for instance, an incremental coder may be used that is driven, for instance, by a support roller, a velocity sensor may be used that is driven, for instance, by a guide roller, or a sound-based device for detecting travel movements may also be used, of course. Other evaluation routines are used appropriately in the assembly state 49 depending on connection elements 27 and sensors used.

The connecting device 14 illustrated may also be modified. For instance, the dead man's switch may be realized separately, apart from the connecting device.

The various connectors for connecting connection elements 27 do not have to be separate connecting positions. Connecting strips with connection sites, optical interfaces, or even wireless connection sites may be used.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A monitoring device for an elevator system having an elevator car for monitoring a movement of the elevator car, comprising:

a sensor system for detecting a movement variable associated with the elevator car;

an analysis device for evaluating the detected movement variable and comparing the detected movement variable to a threshold, where the detected movement variable exceeds the threshold, and a triggering a signal output to actuate a brake or catching device of the elevator car, wherein the monitoring device selects the threshold from specified thresholds based on a state of the monitoring device; and the monitoring device indicates at least one of a normal state and an assembly state;

wherein when indicating the normal state, specified thresholds comprise at least one normal operation threshold, and the monitoring device indicates the normal state as soon as specified connection elements are connected to the monitoring device;

wherein the monitoring device selects a normal operation threshold from the specified thresholds as soon as the normal state is indicated; and wherein the analysis device compares the evaluated detected movement variable to the normal operation threshold;

and, wherein when indicating the assembly state, the specified thresholds comprise an assembly threshold, and the monitoring device indicates the assembly state as long as specified ones of the connection elements are absent from connection to the monitoring device;

wherein the monitoring device selects the assembly threshold from the specified thresholds as long as the assembly state is indicated; and wherein the analysis device compares the evaluated detected movement variable to the assembly threshold.

2. The monitoring device according to claim 1 wherein the monitoring device comprises a checking routine for determining the state of the monitoring device, and the checking routine indicates the normal threshold as soon as the specified connection elements are connected to the monitoring device, and the checking routine indicates the assembly state as long as the specified connection elements are not connected to the monitoring device.

3. The monitoring device according to claim 1 wherein in the assembly state the monitoring device further includes a reset function that resets the signal output and permits the actuated brake or catching device to be reset, wherein the reset function may be initiated manually, or may be initiated automatically in response to the analysis device determining an upward movement of the elevator car or in response to a drop below the assembly threshold during a specified period.

4. The monitoring device according to claim 1 wherein in the assembly state the monitoring device includes a dead man's switch so that in response to the dead man's switch not being actuated the signal output is triggered and the brake or catching device is actuated.

5. The monitoring device according to claim 1 wherein for detecting the movement variable, the sensor system includes at least two redundantly working accelerometers that detect an acceleration of the elevator car, and at least one of wherein the assembly threshold represents a threshold acceleration and the signal output is triggered for actuating the brake or the catching device in response to the detected acceleration exceeding the threshold acceleration, and wherein the assembly threshold represents a permissible assembly velocity and the signal output is triggered for actuating the brake or the catching device in response to a velocity determined from the detected acceleration exceeding the permissible assembly velocity.

6. The monitoring device according to claim 1 wherein at least one of:

the assembly threshold is a travel velocity of the elevator car of a maximum of 0.5 m/s, or a maximum of 0.3 m/s;

the assembly threshold is a threshold acceleration of a maximum of 9.81 $m/s^2$, or a maximum of 6.0 $m/s^2$; and the assembly threshold is a temporally weighted acceleration or travel velocity, wherein a specified acceleration or travel velocity may only be exceeded during a specified period of time.

7. The monitoring device according to claim 1 wherein in the normal state, the analysis device evaluates the detected movement variable taking into account the specified connection elements.

8. The monitoring device according to claim 1 wherein the specified connection elements include at least one velocity sensor for detecting a travel velocity, or a path sensor for detecting traveled units of a path, or a position determination system, or a connection to an elevator control unit, or a connection to a safety circuit, or a connection to a power supply.

9. An assembly device for assembling a shaft retrofit of an elevator system and including the monitoring device according to claim 1, comprising:

a movable assembly platform;

the monitoring device being arranged on the assembly platform;

a brake or catching device attached to the assembly platform and being connected to the monitoring device for triggering by the monitoring device; and a connecting unit supplying the monitoring device with electrical energy.

10. The assembly device according to claim 9 wherein the connecting unit includes an energy module having at least one electrical energy storage unit, wherein the at least one electrical energy storage unit operates the monitoring device together with the brake or catching device, and wherein the at least one electrical energy storage unit is exchangeable or rechargeable, or wherein the connecting unit is a power supply unit for connecting to a conventional local electrical power supply.

11. The assembly device according to claim 10 wherein the connecting unit, the energy module, or the at least one electrical energy storage unit has a charging control element that indicates an insufficient charge reserve for the at least one electrical energy storage unit or the energy module, and wherein the monitoring device actuates the brake or catching device in response to a drop below a specified charge reserve.

12. The assembly device according to claim 11 wherein the connecting unit or the energy module has a buffer that maintains an energy supply for the monitoring device while the at least one electrical energy storage unit is being exchanged.

13. The assembly device according to claim 10 wherein the connecting unit includes a display element for displaying at least one of an operation state of the monitoring device and a travel velocity.

14. The assembly device according to claim 10 wherein the connecting unit includes switching equipment for at least one of manually resetting and actuating a dead man's switch.

15. A method for assembling an elevator system using the monitoring device according to claim 1, the method comprising the steps of:

assembling a movable assembly platform;

arranging the monitoring device and at least one brake or catching device on the assembly platform and connecting the at least one brake or catching device to the monitoring device; and connecting the monitoring device to a connecting unit for supplying the monitoring device with electrical energy.

16. The method according to claim 15 including connecting a dead man's switch to the monitoring device and wherein the at least one brake or catching device is actuated when the dead man's switch is unactuated.

* * * * *